US008044012B2

(12) United States Patent
Yoshikawa et al.

(10) Patent No.: US 8,044,012 B2
(45) Date of Patent: Oct. 25, 2011

(54) DETERGENT COMPOSITION FOR AUTOMATIC DISHWASHING MACHINES

(75) Inventors: Masashi Yoshikawa, Wakayama (JP); Nobuhiro Nishizawa, Wakayama (JP); Takashi Kawashima, Wakayama (JP); Tadashi Nishimori, Wakayama (JP)

(73) Assignee: Kao Corporation, Tokyo (JP)

( * ) Notice: Subject to any disclaimer, the term of this patent is extended or adjusted under 35 U.S.C. 154(b) by 507 days.

(21) Appl. No.: 11/992,295

(22) PCT Filed: Sep. 25, 2006

(86) PCT No.: PCT/JP2006/319615

§ 371 (c)(1), (2), (4) Date: Mar. 20, 2008

(87) PCT Pub. No.: WO2007/037448

PCT Pub. Date: Apr. 5, 2007

(65) Prior Publication Data

US 2009/0264332 A1 Oct. 22, 2009

(30) Foreign Application Priority Data

Sep. 30, 2005 (JP) ..... 2005-288191
Mar. 10, 2006 (JP) ..... 2006-066006

(51) Int. Cl.

| | |
|---|---|
| ***C11D 7/22*** | (2006.01) |
| ***C11D 7/26*** | (2006.01) |
| ***C11D 7/32*** | (2006.01) |
| ***C11D 7/42*** | (2006.01) |

(52) U.S. Cl. ..... 510/226; 510/227; 510/228; 510/230; 510/444; 510/445; 510/466; 510/467; 510/475; 510/509; 134/25.2

(58) Field of Classification Search ..... 510/226, 510/227, 228, 230, 232, 444, 445, 466, 467, 510/475, 509; 134/25.2
See application file for complete search history.

(56) References Cited

U.S. PATENT DOCUMENTS

| | | | | |
|---|---|---|---|---|
| 4,784,789 | A | 11/1988 | Jeschke et al. | |
| 5,308,532 | A | 5/1994 | Adler et al. | |
| 6,326,343 | B1 | 12/2001 | Ghatlia et al. | |
| 2001/0014657 | A1 * | 8/2001 | Assmann et al. | 510/349 |
| 2003/0083223 | A1 | 5/2003 | Aubay et al. | |
| 2003/0171245 | A1 * | 9/2003 | Goovaerts et al. | 510/444 |
| 2004/0005990 | A1 | 1/2004 | Aubay et al. | |
| 2004/0121933 | A1 | 6/2004 | Dougherty | |

FOREIGN PATENT DOCUMENTS

| | | | |
|---|---|---|---|
| EP | 1 431 332 | A1 | 6/2004 |
| GB | 2 104 091 | A | 3/1983 |
| JP | 58-13700 | A | 1/1983 |
| JP | 62-260895 | A | 11/1987 |
| JP | 6-9726 | A | 1/1994 |
| JP | 10-195482 | A | 7/1998 |
| JP | 2003-505535 | A | 2/2003 |
| JP | 2004-508456 | A | 3/2004 |
| JP | 2004-211085 | A | 7/2004 |
| JP | 2005-527686 | A | 9/2005 |
| WO | WO-99/05248 | A1 | 2/1999 |
| WO | WO-99/58633 | A1 | 11/1999 |
| WO | WO-02/20709 | A2 | 3/2002 |
| WO | WO 03/0999980 | A1 | 12/2003 |

OTHER PUBLICATIONS

EnglishTranslation of JP-10-195482-A dated Jul. 28, 1998.
Japanese Office Action mailed Aug. 10, 2010 for Japanese Application No. 2006-066006.

* cited by examiner

*Primary Examiner* — Gregory Delcotto
(74) *Attorney, Agent, or Firm* — Birch, Stewart, Kolasch & Birch, LLP

(57) ABSTRACT

The present invention relates to a detergent composition for automatic dishwashing machines, containing (A) particles containing 0.05 to 10% by mass of (a) a polymer compound having a monomer unit with a cationic group and another monomer unit with an anionic group at a molar ratio [the total number of moles of cationic groups]/[the total number of moles of anionic groups] of 30/70 to 90/10, wherein the content of the polymer compound (a) in the detergent composition is 0.05 to 1.5% by mass.

6 Claims, No Drawings

DETERGENT COMPOSITION FOR AUTOMATIC DISHWASHING MACHINES

FIELD OF THE INVENTION

The present invention relates to a detergent composition for automatic dishwashing machines.

BACKGROUND OF THE INVENTION

Techniques of applying polymer compounds having cationic groups and anionic groups to detergent compositions for automatic dishwashing machines have already been known, and WO-A 99/58633, WO-A 02/20709, EP-A 0998548, JP-A 2003-505535 and JP-A 2005-527686 can serve as references.

In recent years, automatic dishwashing machines are rapidly becoming widespread, and from the viewpoint of energy saving and resource saving, washing machines for reducing the amount of washing water used and for increasing the amount of tableware washed once have became mainstream. However, when tableware with much dirt is washed with such dishwashing machines, there is a problem of frequent occurrence of white deposited matter known as water spots on tableware after washing/drying, and there is strong demand for solving this problem.

As the technique of detergents for suppressing formation of such water spots, a technique of applying a cationic polymer compound or an amphoteric polymer compound is disclosed in WO-A 99/58633. There are also disclosed techniques of applying a cationic polymer compound or an amphoteric polymer compound as an inhibitor of formation of phosphate scales in WO-A 02/20709 and as a fading or corrosion inhibitor in EP-A 0998548. JP-A 2003-505535 and JP-A 2005-527686 disclose respectively techniques of a copolymer consisting of a diallylammonium monomer, a monomer having an acidic functional group and another monomer as an antiredeposition agent, and particularly JP-A 2005-527686 supra describes a detergent for machine-washing of kitchen goods and tableware, which is compounded with a solid, preliminarily compounded product containing said polymer adsorbed on, and/or absorbed to, a water-soluble inorganic carrier.

SUMMARY OF INVENTION

The present invention relates to a detergent composition for automatic dishwashing machines, containing (A) particles containing 0.05 to 10% by mass of (a) a polymer compound having a monomer unit with a cationic group and another monomer unit with an anionic group at a molar ratio [the total number of moles of cationic groups]/[the total number of moles of anionic groups] of 30/70 to 90/10, the content of the polymer compound (a) in the detergent composition being 0.05 to 1.5% by mass.

The present invention also relates to a process for producing the above shown detergent composition for automatic dishwashing machines, which including producing particles (A) by mixing an aqueous solution containing 5 to 80% by mass of (a) a polymer compound having a monomer unit with a cationic group and another monomer unit with an anionic group at a molar ratio [the total number of moles of cationic groups]/[the total number of moles of anionic groups] of 30/70 to 90/10, with one or more compounds selected from a solid water-soluble organic compound an aqueous solution of which, when dissolved at a concentration of 1% by mass in water, has pH 3 to 12 at 20° C. and a water-soluble inorganic salt an aqueous solution of which, when dissolved at a concentration of 1% by mass in water, has pH 3 to 12 at 20° C.

Further, the present invention provides use of the above shown composition or a composition obtained by the above shown process for a detergent for automatic dishwashing machines.

DETAILED DESCRIPTION OF THE INVENTION

When a cationic polymer compound or an amphoteric polymer compound is incorporated into a powdery or granular detergent composition for automatic dishwashing machines, there is a problem that the storage stability of the composition is significantly deteriorated thus causing caking etc., and simultaneously the storage stability of generally used inorganic peroxides is adversely influenced thus significantly deteriorating detergency performance after storage. However, the publications supra do not solve such a problem occurring when a predetermined polymer compound is allowed to be present in a solid, granular or powdery detergent composition.

Accordingly, the present invention relates to provide a composition for automatic dishwashing machines, which is excellent in an ability to suppress water-spot formation, is free of a problem in storage stability such as caking, and is free of a problem in detergency performance after storage particularly when the composition contains inorganic peroxides.

According to the present invention, there is provided a composition for automatic dishwashing machines, which is excellent in an ability to suppress water-spot formation, is free of a problem in storage stability such as caking, and is free of a problem in detergency performance after storage particularly when the composition contains inorganic peroxides.

The particles (A) may contain the polymer compound (a), a solid water-soluble organic compound, a water-soluble inorganic salt or a mixture thereof.

In the present invention, a polymer compound (a) (referred to hereinafter as "component (a)") containing a monomer unit having a cationic group (referred to hereinafter as "monomer unit (a1)") and another monomer unit having an anionic group (referred to hereinafter as "monomer unit (a2)") is used.

The monomer unit (a1) is preferably a monomer unit represented by the following general formula (1) and/or (2):

(1)

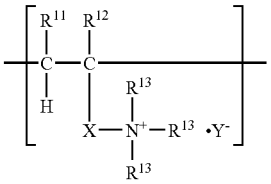

(2)

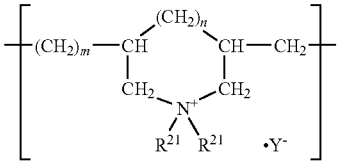

wherein $R^{11}$ represents a hydrogen atom or a methyl group, $R^{12}$ represents a hydrogen atom, a methyl group or a hydroxy group, $R^{13}$ represents a C1 to C3 alkyl or hydroxyalkyl group;

X represents —$COOR^{14}$— or —$CON(R^{15})R^{16}$— whereupon $R^{14}$ and $R^{16}$ each represent a C2 to C5 alkylene group and $R^{15}$ represents a hydrogen atom or a methyl group; $R^{21}$ represents a C1 to C3 alkyl or hydroxyalkyl group, each of m and n is a number of 0 or 1 provided that m+n=1; and $Y^-$ is an anionic group.

In the general formula (1), $R^{11}$ is preferably a hydrogen atom; $R^{12}$ is preferably a hydrogen atom or a methyl group; X is preferably —$CON(R^{15})R^{16}$— wherein $R^{15}$ is preferably a hydrogen atom; $R^{13}$ is preferably a methyl group, and $Y^-$ is preferably a halogen ion, a sulfate ion, a C1 to C3 alkyl sulfate ion, a phosphate ion, a C1 to C12 fatty acid ion, or a benzene sulfonate ion optionally substituted with one to three C1 to C3 alkyl groups, and is more preferably a chlorine ion.

In the general formula (2), $R^{21}$ is preferably a methyl group, and $Y^-$ is preferably a halogen ion, a sulfate ion, a phosphate ion, a C1 to C12 fatty acid ion, or a benzene sulfonate ion optionally substituted with one to three C1 to C3 alkyl groups, and is more preferably a chlorine ion. n is preferably 0.

The monomer unit (a2) is preferably a monomer unit of the following general formula (3):

(3)

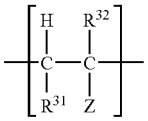

wherein $R^{31}$ represents a hydrogen atom, a methyl group, or —COOM, $R^{32}$ represents a hydrogen atom, a methyl group or a hydroxyl group, and Z is —COOM or -ph-$SO_3M$ whereupon M is a hydrogen atom, an alkali metal or an alkaline earth metal, and ph is a benzene ring.

In the present invention, the component (a) may be a structure (a12) having a cationic group and an anionic group in one monomer unit. Specifically, such monomer unit is preferably a monomer unit represented by the following general formula (4) or (5):

(4)

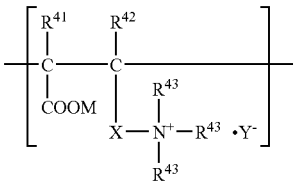

(5)

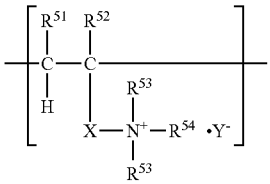

wherein $R^{41}$ and $R^{51}$ each represent a hydrogen atom or a methyl group, $R^{42}$ and $R^{52}$ each represent a hydrogen atom, a methyl group or a hydroxy group; X, $Y^-$ and M have the same meanings as defined above, $R^{43}$ and $R^{53}$ each represent a C1 to C3 alkyl or hydroxyalkyl group, and $R^{54}$ is a group selected from —$CH_2COO$—, —$C_3H_6SO_3$— and —$CH_2CH(OH)CH_2$—$SO_3^-$.

The component (a) in the present invention can be produced by subjecting the monomer corresponding to a monomer unit constituting the component (a) to usual polymerization reaction. Alternatively, a polymer compound may be subjected to post-treatment to give the component (a) finally. The component (a), for example in the case of a polymer compound having a quaternary ammonium group as a cationic group, can be obtained either by polymerization reaction of a monomer having a quaternary ammonium group, in an initial monomer mixture, or by polymerization reaction of a monomer having an amino group and then quaternarizing the resulting polymer. Naturally, the foregoing also applies to a compound having an anionic group. As a matter of course, the monomer used in obtaining the polymer compound requiring post-treatment is a monomer having a structure selected in consideration of the post-treatment.

Examples of the monomer represented by the general formula (1) include acryloyl (or methacryloyl, α-hydroxyacryloyl, or crotonoyl) aminoalkyl (C2 to C5)-N,N,N-trialkyl (C1 to C3) quaternary ammonium salt, and acryloyl (or methacryloyl, α-hydroxyacryloyl, or crotonoyl) oxyalkyl (C2 to C5)-N,N,N-trialkyl (C1 to C3) quaternary ammonium salt. The salt is preferably a salt corresponding to the above-mentioned $Y^-$.

The monomer can be produced by alkylating, with a quaternarizing agent such as methyl chloride, dimethyl sulfate, diethyl sulfate, ethylene oxide or propylene oxide, a monomer unit obtained by polymerizing acryloyl (or methacryloyl, α-hydroxyacryloyl, or crotonoyl) aminoalkyl (C2 to C5)-N,N-dialkyl (C1 to C3) amine or acryloyl (or methacryloyl, α-hydroxyacryloyl, or crotonoyl) oxyalkyl (C2 to C5)-N,N-dialkyl (C1 to C3) amine. When ethylene oxide and/or propylene oxide is used, the monomer unit should be reacted therewith after neutralization of the amino group with an acid represented by YH (Y is the above-mentioned anionic compound).

As the monomer corresponding to the general formula (2) N,N-diallyl-N,N-dialkyl (C1 to C3) quaternary ammonium salt can be used. The monomer can be produced by alkylating, with a quaternarizing agent such as methyl chloride, dimethyl sulfate, diethyl sulfate, ethylene oxide or propylene oxide, a monomer unit obtained by polymerizing N,N-diallyl-N,N-alkyl (C1 to C3) amine. When ethylene oxide and/or propylene oxide is used, the monomer unit should be reacted therewith after neutralization of the amino group with an acid represented by YH (Y is the above-mentioned anionic compound).

The monomer corresponding to the general formula (3) can include acrylic acid or a salt thereof, methacrylic acid or a salt thereof, crotonic acid or a salt thereof, α-hydroxyacrylic acid or a salt thereof, maleic acid or a salt thereof, maleic anhydride, and styrene sulfonate. A monomer unit obtained by polymerizing styrene sulfonate can also be obtained by polymerizing styrene, then sulfonating the resulting compound with a sulfonating agent such as sulfur trioxide, chlorosulfonic acid or sulfuric acid and neutralizing the product.

The polymer compound having the monomer unit of the general formula (4) can be produced by reacting aminoalkyl (C2 to C5) dialkyl (C1 to C3) amine or N,N-dialkyl (C1 to C3)-N-alkanol (C2 to C5) amine with a monomer unit obtained by polymerizing maleic anhydride, and then alkylating the resulting compound with a quaternarizing agent such as methyl chloride, dimethyl sulfate, diethyl sulfate, ethylene oxide or propylene oxide. When ethylene oxide and/or propylene oxide is used, the compound should be reacted therewith after neutralization of the amino group with an acid represented by YH (Y is the above-mentioned anionic compound).

The monomer corresponding to the general formula (5) can include N-[acryloyl (or methacryloyl, α-hydroxyacryloyl, or crotonoyl) aminoalkyl (C2 to C3)]-N,N-dialkyl (C1 to C3)-N-carboxymethyl ammonium carbobetaine, N-[acryloyl (or methacryloyl, α-hydroxyacryloyl, or crotonoyl) aminoalkyl (C2 to C3)]-N,N-dialkyl (C1 to C3)-N-[2-hydroxysulfopropyl] ammonium sulfobetaine, N-[acryloyl (or methacryloyl, α-hydroxyacryloyl, or crotonoyl) aminoalkyl (C2 to C3)]-N,N-dialkyl (C1 to C3)-N-sulfopropyl] ammonium sulfobetaine, N-[acryloyl (or methacryloyl, α-hydroxyacryloyl, or crotonoyl) oxyalkyl (C2 to C3)]-N,N-dialkyl (C1 to C3)-N-carboxymethyl ammonium carbobetaine, N-[acryloyl (or methacryloyl, α-hydroxyacryloyl, or crotonoyl) oxyalkyl (C2 to C3)]-N,N-dialkyl (C1 to C3)-N-[2-hydroxysulfopropyl] ammonium sulfobetaine, and N-[acryloyl (or methacryloyl, α-hydroxyacryloyl, or crotonoyl) oxyalkyl (C2 to C3)]-N,N-dialkyl (C1 to C3)-N-sulfopropyl] ammonium sulfobetaine.

In the present invention, the monomer unit having a cationic group is preferably a monomer unit obtained by polymerizing particularly N,N-diallyl-N,N-dialkyl (C1 to C3) quaternary ammonium salt, or a monomer unit obtained by polymerizing N,N-diallyl-N-alkyl (C1 to C3) amine and alkylated with a quaternarizing agent such as methyl chloride, dimethyl sulfate, diethyl sulfate, ethylene oxide or propylene oxide, and the monomer unit having an anionic group is preferably a monomer unit obtained by polymerizing a monomer selected from acrylic acid or a salt thereof, methacrylic acid or a salt thereof, maleic acid or a salt thereof, and maleic anhydride.

The compound used as the component (a) in the present invention is a polymer compound having a molar ratio [the total number of moles of cationic groups]/[the total number of moles of anionic groups] of 30/70 to 90/10, preferably 40/60 to 70/30, more preferably 50/50 to 70/30. When the anionic group is a carboxylic acid group, the molar ratio is preferably 30/70 to 70/30, more preferably 50/50 to 70/30.

The component (a) in the present invention is preferably a polymer compound wherein all of the monomer unit having a cationic group (a1) and the monomer unit having an anionic group (a2), preferably all of monomer units represented by the general formulae (1) to (5), account for 50 to 100 mol %, preferably 70 to 100 mol %, more preferably 80 to 100 mol %, even more preferably 90 to 100 mol %, based on the whole of monomer units constituting the component (a).

The molar ratio of the monomer unit (a1) to the monomer unit (a2) is determined such that the monomer unit (a1)/[monomer unit (a1)+monomer unit (a2)] is preferably 0.30 to 0.99, more preferably 0.40 to 0.95, even more preferably 0.65 to 0.90.

The polymer compound may contain a monomer unit obtained by copolymerizing a monomer (a3) copolymerizable with the monomer unit having a cationic group and the monomer unit having an anionic group, preferably with the monomer unit selected from the general formulae (1) to (5), to such an extent that the effect of the present invention is not impaired. Specific examples of such monomer units include acrylamide, N,N-dimethylaminopropylacrylic acid (or methacrylic acid) amide, N,N-dimethylacryl (or methacryl) amide, N,N-dimethylaminoethylacrylic acid (or methacrylic acid) amide, N,N-dimethylaminoethylacrylic acid (or methacrylic acid) amide, N-vinyl-2-caprolactam, N-vinyl-2-pyrrolidone, alkyl (C1 to C5) acrylate (or methacrylate), 2-hydroxyethyl acrylate (or methacrylate), N,N-dimethylaminoalkyl (C1 to C5) acrylate (or methacrylate), vinyl acetate, ethylene, propylene, N-butylene, isobutylene, N-pentene, isoprene, 2-methyl-1-butene, N-hexene, 2-methyl-1-pentene, 3-methyl-1-pentene, 4-methyl-1-pentene, 2-ethyl-1-butene, styrene, vinyltoluene, α-methylstyrene, allylamine, N,N-diallylamine, N,N-diallyl-N-alkyl (C1 to C5) amine, ethylene oxide, propylene oxide, 2-vinylpyridine, 4-vinylpyridine, and sulfur dioxide.

Particularly, component (a) having sulfur dioxide copolymerized in an amount of 1 to 15 mol % therein is more preferable.

The component (a) in the present invention can be obtained by any polymerization method, particularly preferably by a radical polymerization method, which can be carried out in a bulk, solution or emulsion system. Radical polymerization can be initiated by heating or with existing radical initiators including azo-based initiators such as 2,2'-azobis(2-amidinopropane) dihydrochloride and 2,2'-azobis (N,N-dimethyleneisobutylamidine) dihydrochloride, hydrogen peroxide, organic peroxides such as benzoyl peroxide, t-butyl hydroperoxide, cumene hydroperoxide, methyl ethyl ketone peroxide and perbenzoic acid, persulfates such as sodium persulfate, potassium persulfate and ammonium persulfate, and redox initiators such as hydrogen peroxide-$Fe^{3+}$, or by light irradiation in the presence and/or absence of a photosensitizer or by exposure to radiation.

The weight-average molecular weight of the component (a) in the present invention is preferably 1,000 to 6,000,000, more preferably 1,000 to 500,000, even more preferably 1,000 to 100,000, even more preferably 5,000 to 60,000. This weight-average molecular weight is determined by gel permeation chromatography with a mixed solvent of acetonitrile and water (phosphate buffer solution) as a developing solvent with polyethylene glycol as standard.

In the present invention, the detergent composition for automatic dishwashing machines contains the component (a) as granules containing the component (a) in an amount of 0.05 to 10% by mass, preferably 0.3 to 10% by mass, more preferably 0.4 to 8% by mass, even more preferably 0.4% by mass or more, and less than 5% by mass (referred to hereinafter as particles (A)).

When the composition of the present invention is a phosphate-free detergent composition for automatic dishwashing machines, a phosphate cannot be used as a carrier for the particles (A), and thus the storage stability of the composition, particularly the storage stability of an inorganic peroxide, tends to decrease. Accordingly in the case of the phosphate-free detergent composition for automatic dishwashing machines, the concentration of the component (a) in the particles (A) is 0.4 to 2% by mass.

The particles (A) are preferably particles containing a solid water-soluble organic compound or a water-soluble inorganic salt, an aqueous solution of which, when dissolved at a concentration of 1% by mass in water, has pH 3 to 12 at 20° C., preferably 4 to 10, more preferably 5 or more, even more preferably 6 or more. The content of the solid water-soluble organic compound and/or the water-soluble inorganic salt in the particles (A) in a dry state or in a crystallization water- or coordinated water-free form is preferably 60 to 99.9% by mass, more preferably 70 to 99% by mass, more preferably 85 to 98% by mass. In the case of the phosphate-free detergent composition, the content is preferably 90% by mass or more.

The solid water-soluble organic compound is preferably a water-soluble organic acid having a molecular weight of 40 to 400, preferably 90 to 360, more preferably 100 to 300, and is more preferably a polyvalent carboxylic acid having, in its molecule, 2 or more, preferably 2 to 6, carboxylic acid groups or a salt thereof. Specifically, the polyvalent carboxylic acid or a salt thereof is preferably a carboxylic acid selected from formic acid, acetic acid, gluconic acid, malic acid, tartaric acid, lactic acid, citric acid, succinic acid, maleic acid and fumaric acid, an aminocarboxylic acid selected from ethylenediaminetetraacetic acid, diethylenetriaminepentaacetic acid, methylglycinediacetic acid, glutamic acid diacetic acid, serinediacetic acid and aspartic acid diacetic acid, or a salt thereof, and is particularly preferably citric acid, methylglycinediacetic acid, ethylenediaminetetraacetic acid or diethylenetriaminepentaacetic acid. The salt is preferably a sodium salt or a potassium salt.

The water-soluble inorganic salt is preferably a sulfate, a hydrochloride or a phosphate, even more preferably a salt that can have crystallization water. Specifically, the water-soluble inorganic salt is preferably sodium sulfate, potassium sulfate or sodium tripolyphosphate.

In the particles (A) of the present invention, the solid water-soluble organic compound and the water-soluble inorganic salt may be simultaneously used, and in the case of the phosphate-free detergent composition, the solid water-soluble organic compound/water-soluble inorganic salt ratio by mass is preferably in the range of 90/10 to 10/90, more preferably 70/30 to 10/90, even more preferably 50/50 to 10/90. When the water-soluble inorganic salt is a phosphate, the solid water-soluble organic compound/water-soluble inorganic salt ratio by mass is preferably in the range of 0/100 to 20/80, more preferably 0/100.

When the detergent composition for automatic dishwashing machines of the present invention is phosphate-free, an aqueous solution of the particles (A), dissolved at a concentration of 1% by mass in water, has pH 5 to 10 at 25° C., more preferably pH 6 to 9. In the phosphate-free composition, the solid water-soluble organic compound and the water-soluble inorganic salt are preferably simultaneously used, and these compounds are used preferably such that the particles (A) exhibit the above-mentioned pH. That is, the particles (A) may contain an acidic substance, but it is preferable in design of the final particles (A) that alkaline particles are simultaneously used thereby regulating the pH in the above range. Examples include weak acid/strong base organic acids or salts different in degree of neutralization. Naturally, a combination of an organic acid salt and a neutral salt can also be used.

In the present invention, the component (a) and the solid water-soluble organic compound, the water-soluble inorganic salt or a mixture thereof are mixed to give particles (A), and from the viewpoint of detergency performance and suppression of water-spot formation, a method of producing the particles (A) by mixing an aqueous solution containing 5 to 80% by mass, preferably 8 to 50% by mass, more preferably 20 to 50% by mass of the component (a), with the solid water-soluble organic compound and/or the water-soluble inorganic salt, is preferable. When the component (a) is used as an aqueous solution, the aqueous solution containing 5 to 80% by mass of the component (a) is adjusted preferably to pH 8 or less at 25° C., more preferably pH 2-7, from the viewpoint of compounding properties, detergency performance, suppression of water-spot formation, and stability. The amount of water in the aqueous solution containing the component (a) influences the effect of the present invention, and when the concentration of the component (a) in the aqueous solution is below the range defined above, the storage stability of the composition tends to decrease and the cleaning effect after storage tends to decrease, and when the concentration of the component (a) is above the range defined above, the cleaning effect tends to decrease.

The mixing ratio of (X) the aqueous solution of the component (a) to (Y) the solid water-soluble organic compound, the water-soluble inorganic salt or a mixture thereof (that is, (X)/(Y) ratio by weight) is preferably 0.2/99.8 to 40/60, more preferably 0.5/99.5 to 20/80, even more preferably 1/99 to 15/85.

Usually, a binder is used in formulation of an active substance, and in the present invention, a small amount of water in the aqueous solution of the component (a) acts as a binder. Other examples of the binder can include polyethylene glycol having a molecular weight of 2,000 to 20,000, C10 to C20 fatty acids, and C10 to C20 fatty alcohols. The amount of such binders is 10% by mass or less, preferably 5% by mass or less, more preferably 3% by mass or less, in the particles (A). However, water used in dissolving the component (a) is more preferably used as the binder.

In the present invention, the aqueous solution of the component (a) is mixed with the solid water-soluble organic compound and/or the water-soluble inorganic salt, and then the mixture is preferably mixed with a water-insoluble inorganic powder for the purpose of improving the physical properties of the particles. The water-insoluble inorganic powder preferably has a primary particle size of 5 nm to 200 μm, preferably 20 nm to 100 μm, even more preferably 20 nm to 50 μm, and specifically, crystalline silicate, aluminosilicate, silica, and alumina are preferable. In the present invention, the ratio of the water-insoluble inorganic powder (Z) to the mixture (Y), that is, the (Z)/(Y) ratio by weight, is preferably 99.9/0.1 to 95/5, more preferably 99.5/0.5 to 97.5/2.5, even more preferably 99.3/0.7 to 98/2.

When silica is used as the water-insoluble inorganic powder, Aerosil (manufacture by Nippon Aerosil), Tokuseal, Fine Seal, Rheoseal (manufactured by Tokuyama Corporation), Silopure (manufactured by Fuji Silysia Chemical Ltd.) etc. are preferably used.

In the present invention, known mixers such as Henschel mixer (manufactured by Mitsui Mining Co., Ltd.), Hi-Speed Mixer (manufactured by Fukae Kogyo Co., Ltd.), Nautor Mixer (manufactured by Hosokawa Micron Co., Ltd.) etc. can be used in the mixing step, among which Nautor Mixer exerting less shear force during stirring is preferably used.

The particles (A) of the present invention may be particles containing 0.05 to 10% by mass, 0.3 to 10% by mass, more preferably 0.4 to 8% by mass of the component (a) and 60 to 99.9% by mass, more preferably 70 to 99% by mass, even more preferably 85 to 98% by mass of the solid water-soluble organic compound and/or the water-soluble inorganic salt in a dry state or in a crystallization water- or coordinated water-free state.

The particles (A) may contain 0.1 to 3% by mass, preferably 0.5 to 2.5% by mass, even more preferably 0.7 to 2% by mass of the water-insoluble inorganic powder.

The content of water is 0.05 to 15% by mass, preferably 0.3 to 15% by mass, even more preferably 0.3 to 10% by mass.

The average particle size of the particles (A) is preferably 50 to 1000 μm, more preferably 100 to 800 μm, even more preferably 100 to 600 μm.

The particles (A) are obtained preferably from particles having a particle size of preferably 10 to 800 μm, more preferably 50 to 800 μm, even more preferably 100 to 500 μm, containing the solid water-soluble organic compound, the water-soluble inorganic salt or a mixture thereof.

The particles (A) may be those particles having the component (a) adhering to the surfaces of particles of the solid water-soluble organic compound and/or the water-soluble inorganic salt, and those particles having the surfaces further coated with (or covered with) the water-insoluble inorganic powder are ideal because of rich fluidity. Depending on the type of the solid water-soluble organic compound and the water-soluble inorganic salt or the type and concentration of the binder, aggregated particles containing component (a) may be formed upon addition of an aqueous solution containing the component (a) or the binder. The surfaces of the aggregated particles may be coated with the water-insoluble inorganic powder.

The detergent composition of the present invention contains the component (a) in an amount of 0.05 to 1.5% by mass, preferably 0.2 to 1.5% by mass, more preferably 0.3 to 1.4% by mass, in the composition. The particles (A) are used such that the content of the component (a) comes to be in this range. 80% by mass or more, especially 90% by mass or more, particularly substantially 100% by mass of the whole of the component (a) in the composition is preferably present in the particles (A). When the particles (A) are prepared, the component (a) is preferably added in the form of an aqueous solution. In this case, the component (a) may be transferred in a small amount to other particles after the particles (A) are mixed with the other particles, and in this case, the particles (A) of the present invention may be present in the range defined in the present invention.

The detergent composition for automatic dishwashing machines of the present invention may be composed exclusively of the particles (A), and in this case, the water-soluble inorganic salt and/or the solid water-soluble organic compound that can increase detergency is preferably mixed with the particles (A). For example, a phosphate exhibits alkalinity and a buffering ability besides an excellent chelating ability. For increasing the alkalinity of the cleaning liquid, an alkali can be additionally used. It is also proposed that an organic chelating agent such as citric acid (citrate) as the solid water-soluble organic compound and an alkali agent such as carbonate as the water-soluble inorganic solid are simultaneously used. In the present invention, however, a highly alkaline substance is compounded preferably as separate particles, from the viewpoint of storage stability. An enzyme and a bleaching agent are also compounded preferably as separate particles from the viewpoint of stability and easy handling. Specifically, one or more kinds of particles selected from alkali metal carbonate-containing particles (B), aluminosilicate- and silicate-containing particles (C), inorganic peroxide-containing particles (D), and enzyme-containing particles (E) are contained as particles other than the particles (A), and particularly all the particles (B) to (E) are preferably contained. In addition to these particles, arbitrary particles (F) may be contained.

As the particles (B), sodium carbonate (light ash, dense ash) can be used, and particularly dense ash having an average particle size of 50 to 600 μm, preferably 100 to 500 μm, is preferably used. The content of the particles (B) in the composition is preferably 1 to 80% by mass, more preferably 5 to 70% by mass, even more preferably 5 to 40% by mass.

The particles (C) are particles used for the purpose of improving the cleaning effect, and are used for the purpose evidently different from that of the powdery physical property modifier as the particles (A). The silicates are preferably amorphous sodium silicate such as No. 1, 2 or 3 sodium silicate, crystalline silicates described in JP-A 7-89712, JP-A 60-227895, Phys. Chem. Glasses, vol. 7, pp. 127-138 (1966), and Z. Kristallogr., vol. 129, pp. 396-404 (1969), and crystalline sodium silicate available from Tokuyama Silteck under the trade name "Prifeed" ($\delta$-$Na_2Si_2O_5$). The aluminosilicates are preferably amorphous aluminosilicates and can include amorphous aluminosilicates described in JP-A 62-191417, page 2, lower right column, line 19 to page 5, upper left column, line 17 (particularly the initial temperature is preferably in the range of 15 to 60° C.), JP-A 62-191419, page 2, lower right column, line 20 to page 5, upper left column, line 11, and amorphous aluminosilicates described in JP-A 9-132794, JP-A 7-10526, JP-A 6-227811, JP-A 8-119622 etc.

The particles (C) are more preferably crystalline sodium silicate having an average particle size of 1 to 1000 μm, preferably 5 to 800 μm.

The content of the particles (C) in the composition is preferably 1 to 20% by mass, more preferably 3 to 15% by mass, even more preferably 3 to 10% by mass.

The particles (D) are inorganic peroxide-containing particles. Specific examples include percarbonates, preferably sodium percarbonate (hereinafter referred to sometimes as PC), perborates, preferably sodium perborate. When a percarbonate is used, a coated percarbonate is preferably used from the viewpoint of storage stability.

The coated percarbonate is preferably coated with a water-soluble polymer, an inorganic salt, etc. Specifically, sodium percarbonate coated in a known method can be used, and for example, it is possible to use coated PC obtained by known processes disclosed in, for example, JP-B-47-32200 (paraffin-coated PC), JP-B 53-15717 (sodium perborate-coated PC), U.S. Pat. No. 4,131,562 (PC coated with sodium perborate and an alcohol-ethylene oxide adduct), U.S. Pat. No. 4,120,812 (PC and/or sodium perborate coated with polyethylene glycol), German Patent 2712139 (silicate-coated PC), German Patent 2800916 (boric acid-coated PC), European Patent 30759 (wax-coated PC), JP-A 58-217599 (borate-coated PC), JP-A 59-196399 (borate-coated PC), and JP-A 4-31498 (PC separately spray-coated with boric acid and a silicate).

In the present invention, the percarbonate is preferably (i) a percarbonate coated with 0.1 to 30% by mass (based on the percarbonate) of sodium borate, particularly sodium metaborate or sodium orthoborate, (ii) a percarbonate coated with 0.3 to 20% by mass, preferably 0.5 to 10% by mass, even more preferably 1 to 8% by mass, (based on the percarbonate) of a boric acid selected from orthoboric acid, metaboric acid, and tetraboric acid or (iii) a percarbonate coated with 0.1 to 10% by mass, particularly 0.2 to 7% by mass, especially 0.3 to 5% by mass, (based on the percarbonate) in term of $SiO_2$ of a silicate, e.g., sodium metasilicate, sodium orthosilicate, sodium salt of No. 1, 2 or 3 water glass, potassium metasilicate or potassium orthosilicate, preferably sodium salts of No. 1, 2 or 3 water glass. Particularly, the percarbonate (i) is preferably from the viewpoint of storage stability. The percarbonate is preferably sodium percarbonate.

The coated percarbonate in the present invention is produced in a usual manner. The coated percarbonate can be produced for example by bringing the percarbonate, wet or dry, into contact with a coating material in the form of a solution or powder by mixing or adsorption and drying.

The average particle size of the coated percarbonate is preferably 100 to 2000 μm, preferably 250 to 1000 μm, from the viewpoint of bleaching cleaning effect.

The content of the particles (D) in the composition is preferably 0.5 to 99% by mass, more preferably 5 to 70% by mass, even more preferably 5 to 50% by mass.

In the present invention, the enzyme-containing particles (E) are preferably contained, and the enzyme includes cellulase, protease, lipase, amylase, esterase, pectinase, lactase and peroxidase among which protease and amylase are particularly preferable.

Commercial enzymes usable as protease can include Alcalase, Savinase, Everlase, Kannase, Esperase (Novo Nordisk Bioindustry), Ovozyme, Purafect, Properase, and Purafect OX (Genencor International).

Commercial enzymes usable as amylase can include Rapidase (Gist-brocase), Termamyl, Duramyl, Stainzyme (Novo Nordisk Bioindustry), Plaster ST and Plaster OxAm (Genencor International).

Preferably, protease and amylase are simultaneously used in the present invention, and the amylase/protease mass ratio, in terms of the amount of enzyme protein, is preferably 1/99 to 94/6, more preferably 2/98 to 90/10, even more preferably 20/80 to 80/20.

Preferably, particles obtained by granulating these enzymes can be contained in the present invention. The amount of the enzyme protein in the granulated product is 1 to 30% by mass, preferably 2 to 25% by mass, based on the particles (E). The average particle size of the particles (E) is 50 to 1000 μm, preferably 150 to 800 μm.

The content of the particles (E) in the composition is preferably 0.1 to 10% by mass, more preferably 0.2 to 7% by mass, even more preferably 0.2 to 5% by mass.

The detergent composition for automatic dishwashing machines of the present invention can contain a surfactant. When a surfactant is contained, the amount of the surfactant is preferably minimized from the viewpoint of suppression of water-spot formation, and the content of the surfactant in the composition is preferably 10% by mass or less, more preferably 5% by mass or less. As the surfactant, a nonionic surfactant consisting of an oxypropylene/oxyethylene copolymer is preferably lower than 0.01% by mass.

In the present invention, polypropylene glycol having a weight-average molecular weight of 600 to 5000, preferably 2000 to 4000, is preferably incorporated into the composition in order to confer a cleaning effect and to prevent an odor from remaining on tableware after washing. The content of polypropylene glycol in the composition is preferably 0.1 to 10% by mass, more preferably 0.5 to 5% by mass, even more preferably 1 to 5% by mass.

In addition, a colorant, a perfume, a defoaming agent, polyacrylic acid and a salt thereof, an acrylic acid/maleic acid copolymer and a salt thereof, and a bleaching activator such as tetraacetylethylene diamine (TAED) can be mentioned as arbitrary components.

These compounds that can be arbitrarily incorporated may be added to the respective particles to such an extent that the stability and properties of the components are not impaired, or these compounds may be incorporated separately as particles (F). Alternatively, these compounds may be added by spraying in the form of a liquid, or as fine particles (or powder), after the particles (A) to (F) are mixed.

The average particle size of the detergent composition for automatic dishwashing machines of the present invention is preferably 100 to 1000 μm, more preferably 200 to 700 μm. The bulk density of the composition is preferably 0.8 to 1.5 g/cm$^3$, more preferably 0.8 to 1.2 g/cm$^3$.

The average particle size, primary particle size and bulk density described in the present invention are measured in the following manner.

<Method of Measuring Average Particle Size>

The average particle size is a medium diameter measured using sieves according to JIS Z 8801. For example, nine-step sieves each having a sieve-opening of 2000 μm, 1400 μm, 1000 μm, 710 μm, 500 μm, 350 μm, 250 μm, 180 μm, or 125 μm, and a receiving tray are used, and the sieves and the receiving tray are attached to a rotating and tapping shaker machine (manufactured by HEIKO SEISAKUSHO, tapping: 156 times/min, rolling: 290 times/min). A 100 g sample is vibrated for 5 minutes, and then the proportion of the particles having the respective particle sizes is determined based on mass fraction by the size of screen mesh opening, to determine the average particle size.

<Method of Measuring Primary Particle Size>

The sizes of 3,000 particles are measured by a scanning or transmission electron microscopy, and then divided by the number of particles to determine the average particle size.

<Method of Measuring Bulk Density>

The bulk density is measured according to a method prescribed in JIS K 3362.

Further preferable modes of the present invention are described below.

The component (a) is preferably a polymer compound (hereinafter referred to as component (a')) having a weight-average molecular weight of 5,000 to 1,000,000, containing the monomer unit having a cationic group (a1), that is, a monomer unit obtained by polymerizing N,N-diallyl-N,N-dialkyl (C1 to C3) quaternary ammonium salt or a monomer unit obtained by polymerizing N,N-diallyl-N-alkyl (C1 to C3) amine and alkylated with a quaternarizing agent such as methyl chloride, dimethyl sulfate, diethyl sulfate, ethylene oxide or propylene oxide; the monomer unit having an anionic group (a2), that is, a monomer unit derived from a monomer selected from acrylic acid or salts thereof (the salts include those formed by neutralization after copolymerization; this definition applies hereinafter), methacrylic acid or salts thereof, maleic acid or salts thereof, and maleic anhydride; and a monomer unit derived from the other copolymerizable monomer (a3), wherein the molar ratio [the total number of moles of cationic groups]/[the total number of moles of anionic groups] is 50/50 to 70/30, and both the monomer unit having a cationic group (a1) and the monomer unit having an anionic group (a2) account for 90 to 100 mol % based on the whole of monomer units constituting the component (a). This preferable component (a') is preferably used in production of particles (A) which contain 20 to 50% by mass of the component (a') and an aqueous solution of which, when converted into an aqueous solution, has pH 8 or less at 25° C., particularly pH 2 to 7. Hereinafter, specific particle conditions are shown below.

Particles (A) The content thereof as component (a) in the composition is 0.4 to 1.0% by mass. The particles (A) are those particles having an average particle size of 100 to 500 μm and containing 0.5 to 8% by mass of the component (a) and the component (a'), 7 to 50% by mass of one or more water-soluble inorganic salts having an average particle size of 100 to 500 μm selected from sodium sulfate, sodium tripolyphosphate and potassium sulfate, 7 to 50% by mass of a solid water-soluble organic compound having an average particle size of 100 to 500 μm selected from citric acid, methylglycinediacetic acid, ethylenediaminetetraacetic acid, diethylenetriaminepentaacetic acid and salts thereof, and 0.5 to 2% by mass of a water-insoluble inorganic powder selected from crystalline silicate, aluminosilicate, silica and alumina with which the particles (A) are coated, wherein the solid water-soluble organic compound/water-soluble inorganic salt ratio by mass is 50/50 to 10/90.

Particles (B) The content thereof in the composition is 5 to 40% by mass. The particles (B) are light ash and dense ash (both of which refer to sodium carbonate) having an average particle size of 100 to 500 μm.

Particles (C) The content thereof in the composition is 3 to 10% by mass. The particles (C) are crystalline layered sodium silicate (for example, δ-$Na_2Si_2O_5$) having an average particle size of 5 to 800 μm.

Particles (D) The content thereof in the composition is 5 to 50% by mass. The particles (D) are sodium percarbonate having an average particle size of 250 to 1000 μm.

Particles (E) The content thereof in the composition is 0.2 to 5% by mass. The particles (E) are amylase- and protease-containing particles having an average particle size of 150 to 800 μm.

Particles (F) The content thereof in the composition is 0 to 5% by mass. The particles (F) are arbitrary particles having an average particle size of 50 to 1500 μm, which are particles consisting of other additives or increasing the added value, and for example, perfume particles exhibiting deodorizing properties and particles such as acrylic acid/maleic acid copolymer salts for dispersion of dirt can be proposed. The detergent composition for automatic dishwashing machines further contains a particle group having properties different from those shown above, which is compounded with the particles (A) to (F) having sizes as uniform as possible to prevent the particles from being separated (generally classified) into layers by vibration etc.

EXAMPLES

The present invention is described by reference to the Examples, but the Examples are set forth for merely illustrative purposes and not intended to limit the scope of the present invention.

<Process for Producing Particles (A)>

Example 1 to 3 and Comparative Examples 1, 2 and 4

Sodium sulfate and trisodium citrate were added to a 30-L Nautor mixer (rotation, 110 rpm; revolution, 4 rpm) and mixed for 1 minute. Then, an aqueous solution of each of synthetic polymer compounds (a-1) to (a-3) or a comparative synthetic polymer compound was added thereto and mixed for 5 minutes. Then, a surface modifier (half amount of the surface modifier added to the detergent composition) was added to, and mixed for 1 minute with, the mixture to obtain particles (A). The amount of each component added was an amount calculated from the compounding ratios shown in Table 1 corresponding to 30 kg of the detergent composition.

Comparative Example 3

0.3 kg of sodium sulfate and 0.3 kg of trisodium citrate were added to 0.6 kg of an aqueous solution of the synthetic polymer compound (a-2), and 0.6 kg of deionized water was added thereto followed by mixing, and the resulting aqueous solution was spray-dried thereby to obtain particles (A).

<Process for Producing Detergent Compositions>

Examples 1 to 3 and Comparative Example 4

After the Particles (A) were produced, the particles (B), particles (C) and particles (F) were added thereto and mixed for 1 minute. Then, polypropylene glycol was added and mixed for 3 minutes, and a surface modifier (half amount of the surface modifier added to the detergent composition) was added and mixed for 1 minute. Then, the particles (D) and particles (E) were added and a perfume was added, and the mixture was further mixed for 3 minutes to obtain 30 kg detergent composition.

Comparative Example 1

After the particles (A) (wherein the component (a) and a surface modifier were not contained) were produced, the particles (B), particles (C) and particles (F) were added and mixed for 1 minute. Then, polypropylene glycol was added and mixed for 3 minutes, and a surface modifier (the whole amount of the surface modifier to add to the detergent composition) was added, and the mixture was further mixed for 1 minute. Then, the particles (D) and particles (E) were added, and a perfume was added, and the mixture was further mixed for 3 minutes to obtain 30 kg detergent composition.

Comparative Example 2

After the particles (A) (wherein the component (a) and a surface modifier were not contained) were produced, the particles (B), particles (C) and particles (F) were added and mixed for 1 minute. Then, polypropylene glycol was added and mixed for 3 minutes, and a surface modifier (the whole amount of the surface modifier to add to the detergent composition) was added, and the mixture was further mixed for 1 minute. Then, a component (synthetic polymer compound (a-1) powdery product) obtained by spray-drying the particles (D), the particles (E) and the component (a) was added and a perfume was added, and the mixture was further mixed for 3 minutes to obtain 30 kg detergent composition.

Comparative Example 3

The particles (A) (wherein a surface modifier was not contained) were added to a 30-L Nautor mixer (rotation, 110 rpm; revolution, 4 rpm), and the particles (B), particles (C) and particles (F) were added and mixed for 1 minute. Then, polypropylene glycol was added and mixed for 3 minutes, and a surface modifier (the whole amount of the surface modifier to add to the detergent composition) was added, and the mixture was further mixed for 1 minute. Then, the particles (D) and particles (E) were added and a perfume was added, and the mixture was further mixed for 3 minutes to give 30 kg detergent composition.

<Washing Conditions>

Tableware below and a detergent composition in Table 1 were introduced into an automatic dishwashing machine (model NP-60SS5, manufactured by Matsushita Electric Industrial Co., Ltd.) which was then operated in a standard course. This washing machine works by heating 2.2 L water gradually from 20° C. to 60° C., subsequent washing, and conducting rinsing 3 times (without temperature rising), followed by final rinsing (rinsing at a rising temperature from 20° C. to 70° C.) and drying.

Stained dishes: 10 plates (prepared by the following method)

Unstained cups: 9 cups

Unstained glass slides: 3 plates

Used water: 3.5° DH water

Amount of the detergent composition added: 6 g

<Preparation of Stained Dishes>

Over-medium eggs were mashed and passed through a net of 1 mm in opening, and 1.8 g of the filtrate was applied onto each porcelain dish of 11 cm in diameter as uniformly as possible and left for 1 hour, and the dishes thus treated were then subjected to washing.

<Method of Evaluating Glass Cups after Washing>

Water spots formed on a glass cup after washing were counted by holding it against a fluorescent light and evaluated under the following criteria. The results are shown in Table 1.

◎: The average number of water spots on 9 glass cups is 25 or less.

○: The average number of water spots on 9 glass cups is from 26 to 40.

Δ: The average number of water spots on 9 glass cups is from 41 to 100.

x: The average number of water spots on 9 glass cups is 101 or more.

<Measurement of Contact Angle>

The contact angle of distilled water on each of 3 glass slides after washing was measured and the average contact angle was calculated.

<Storage Stability>

700 g detergent composition in Table 1 was introduced into a box container (Kitchen Quickle container manufactured by Kao Corporation) and stored for 30 days in a thermostat bath at 40° C. under 80% humidity, and after storage, the state of the composition was observed, and when there was no change after storage, ◎ was given; when there was no problem in performance although slight aggregation of particles in the composition was observed, ○ was given; when slight aggregation of particles in the composition was observed and deterioration in performance was recognized, Δ was given; and when significant aggregation of particles in the composition was observed, X was given.

TABLE 1

| | | | | Examples | | | Comparative examples | | | |
|---|---|---|---|---|---|---|---|---|---|---|
| | | | | 1 | 2 | 3 | 1 | 2 | 3 | 4 |
| Detergent composition | Composition (mass %) | Particles (A) | Synthetic polymer compound (a-1)[1] | 0.5 | — | — | — | — | — | — |
| | | | Synthetic polymer compound(a-2)[2] | — | 0.5 | — | — | — | 0.5 | — |
| | | | Synthetic polymer compound (a-3)[3] | — | — | 0.5 | — | — | — | — |
| | | | Comparative synthetic polymer compound[4] | — | — | — | — | — | — | 0.5 |
| | | | Sodium sulfate | 25.9 | 25.1 | 22.1 | 27.1 | 26.6 | 1 | 25.1 |
| | | | Trisodium citrate | 20 | 20 | 20 | 20 | 20 | 1 | 20 |
| | | | surface modifier[5] | 0.8 | 0.8 | 0.8 | — | — | — | 0.8 |
| | | | Water | 0.7 | 1.5 | 4.5 | — | — | 3.5 | 1.5 |
| | | Particle (B) | Sodium carbonate (average particle size 300 μm) | 10 | 10 | 10 | 10 | 10 | 10 | 10 |
| | | Particle (C) | Sodium silicate (average particle size 600 μm) | 5 | 5 | 5 | 5 | 5 | 5 | 5 |
| | | Particle (D) | Sodium percarbonate[6] (average particle size 700 μm) | 30 | 30 | 30 | 30 | 30 | 30 | 30 |
| | | Particle (E) | α-Amylase[7] | 1 | 1 | 1 | 1 | 1 | 1 | 1 |
| | | | Protease[8] | 1 | 1 | 1 | 1 | 1 | 1 | 1 |
| | | Particle (F) | Acrylic acid/maleic acid/copolymer salt[9] | 2 | 2 | 2 | 2 | 2 | 2 | 2 |
| | | Other components | Synthetic polymer compound (a-1) powder produt[10] | — | — | — | — | 0.5 | — | — |
| | | | Polypropylene glycol[11] | 2 | 2 | 2 | 2 | 2 | 2 | 2 |
| | | | Perfume | 0.3 | 0.3 | 0.3 | 0.3 | 0.3 | 0.3 | 0.3 |
| | | | surface modifier[5] | 0.8 | 0.8 | 0.8 | 1.6 | 1.6 | 1.6 | 0.8 |
| | | | Sodium sulfate | — | — | — | — | — | 25.6 | — |
| | | | Trisodium citrate | — | — | — | — | — | 19 | — |
| | | | Total (mass %) | 100 | 100 | 100 | 100 | 100 | 100 | 100 |
| | Content (mass %) of component (a) in particles (A) | | | 1 | 1 | 1 | 0 | 0 | 20 | 1 |
| | Average particle size (μm) of particles (A) | | | 260 | 260 | 260 | 250 | 250 | 200 | 260 |
| | Bulk density (g/cm$^3$) of detergent composition | | | 1.00 | 1.00 | 1.00 | 1.00 | 1.00 | 1.00 | 1.00 |
| | Average particle size (μm) of detergent composition | | | 380 | 380 | 380 | 380 | 380 | 380 | 380 |
| Contact angle (°) on glass slide | | | | 18 | 15 | 18 | 68 | 45 | 15 | 70 |
| glass cup after washing | | | | ◎ | ◎ | ◎ | X | Δ | ◎ | X |
| Storage stability | | | | ◎ | ◎ | ○ | ◎ | X | X | ◎ |

* The polymer compound in the particles (A) in the table was added as an aqueous solution.

Notes:

[1]A copolymer obtained by polymerizing N,N-diallyl-N,N-dimethylammonium chloride and acrylic acid in a molar ratio of 69.5:30.5 (weight-average molecular weight of 450,000; pH 4.7 (25° C.) in an aqueous solution at a concentration of 40% by mass)

[2]A copolymer obtained by polymerizing N,N-diallyl-N,N-dimethylammonium chloride/maleic acid/sulfur dioxide in a molar ratio of 66.7/26.7/6.6 (weight-average molecular weight of 20,000; pH 2.0 (25° C.) in an aqueous solution at a concentration of 25% by mass)

[3]A copolymer obtained by polymerizing N,N-diallyl-N,N-dimethylammonium chloride/acrylic acid/acrylamide in a molar ratio of 36/32/32 (weight-average molecular weight of 1,500,000; pH 6.5 (25° C.) in an aqueous solution at a concentration of 10% by mass)

[4]A copolymer of N,N-diallyl-N,N-dimethylammonium chloride (weight-average molecular weight of 150,000; pH 6.5 (25° C.) in an aqueous solution at a concentration of 40% by mass)

[5]Tokuseal NR (oil absorption: 210 to 270 mL/100 g, manufactured by Tokuyama Corporation), a primary particle size of about 20 nm

[6]Sodium percarbonate coated with sodium metaborate, an average particle size of 700 μm

[7]Duramyl 60T (Novo Nordisk Bioindustry), an average particle size of 600 μm

[8]Savinase 18.0T (Novo Nordisk Bioindustry), an average particle size of 600 μm

[9]Sokalan CP45 (BASF), an average particle size of 400 μm

[10]Powder obtained by spray-drying an aqueous solution containing 40% by mass of a copolymer (weight-average molecular weight of 450,000) obtained by polymerizing N,N-diallyl-N,N-dimethylammonium chloride and acrylic acid in a molar ratio of 69.5:30.5, an average particle size of 200 μm

[11]Weight-average molecular weight of about 3000, an average condensation degree of about 50 (diol type, Wako Pure Chemical Industries, Ltd.)

The invention claimed is:

1. A detergent composition for automatic dishwashing machines, comprising (A) particles comprising 0.05 to less than 5% by mass of (a) a polymer compound having a monomer unit with a cationic group and another monomer unit with an anionic group at a molar ratio [the total number of moles of cationic groups]/[the total number of moles of anionic groups] of 50/50 to 90/10, the content of the polymer compound (a) in the detergent composition being 0.05 to 1.5% by mass;

wherein the particles (A) comprise a solid water-soluble organic compound and a water-soluble inorganic salt in a content of 85 to 99.9% by mass, and the solid water-soluble organic compound/water-soluble inorganic salt ratio by mass is in the range of 50/50 to 10/90;

wherein the solid water-soluble organic compound is a citric acid or a salt thereof;

wherein the water-soluble inorganic salt is at least one member selected from the group consisting of a sulfate, a hydrochloride and a phosphate;

wherein the monomer unit with a cationic group is a monomer unit obtained by polymerizing N,N-diallyl-N,N-dialkyl (C1 to C3) quaternary ammonium salt or a monomer unit obtained by polymerizing N,N-diallyl-N-alkyl (C1 to C3) amine and alkylated with a quaternarizing agent; and wherein the monomer unit with an anionic group is a monomer unit selected from the group consisting of acrylic acid or a salt thereof, methacrylic acid or a salt thereof, maleic acid or a salt thereof, and maleic anhydride.

2. The detergent composition for automatic dishwashing machines according to claim 1, wherein the particles (A) comprise the solid water-soluble organic compound an aqueous solution of which, when dissolved at a concentration of 1% by mass in water, has pH 3 to 12 at 20° C. and the water-soluble inorganic salt an aqueous solution of which, when dissolved at a concentration of 1% by mass in water, has pH 3 to 12 at 20° C.

3. The detergent composition for automatic dishwashing machines according to claim 1, wherein an aqueous solution of the particles (A), dissolved at a concentration of 1% by mass, has pH 5 to 10 at 25° C.

4. The detergent composition for automatic dishwashing machines according to claim 1, wherein one or more kinds of particles selected from the group consisting of alkali metal carbonate-containing particles (B), aluminosilicate- and/or silicate-containing particles (C), inorganic peroxide-containing particles (D), and enzyme-containing particles (E) are contained in addition to the particles (A).

5. A process for producing the detergent composition for automatic dishwashing machines according to claim 1, which comprises a step of producing particles (A) by mixing an aqueous solution comprising 5 to 80% by mass of (a) a polymer compound having a monomer unit with a cationic group and another monomer unit with an anionic group at a molar ratio [the total number of moles of cationic groups]/[the total number of moles of anionic groups] of 50/50 to 90/10, with one or more compounds selected from the group consisting of a solid water-soluble organic compound an aqueous solution of which, when dissolved at a concentration of 1% by mass in water, has pH 3 to 12 at 20° C. and a water-soluble inorganic salt an aqueous solution of which, when dissolved at a concentration of 1% by mass in water, has pH 3 to 12 at 20° C.;

wherein the solid water-soluble organic compound is a citric acid or a salt thereof;

wherein the water-soluble inorganic salt is at least one member selected from the group consisting of a sulfate, a hydrochloride and a phosphate;

wherein the monomer unit with a cationic group is a monomer unit obtained by polymerizing N,N-diallyl-N,N-dialkyl (C1 to C3) quaternary ammonium salt or a monomer unit obtained by polymerizing N,N-diallyl-N-alkyl (C1 to C3) amine and alkylated with a quaternarizing agent; and wherein the monomer unit with an anionic group is a monomer unit selected from the group consisting of acrylic acid or a salt thereof, methacrylic acid or a salt thereof, maleic acid or a salt thereof, and maleic anhydride.

6. A dishwashing method that comprises the steps of introducing into an automatic dishwashing machine the detergent composition for automatic dishwashing machines of claim 1; and contacting tableware with said composition.

* * * * *